US005641306A

United States Patent [19]

Stepniak

[11] Patent Number: 5,641,306

[45] Date of Patent: Jun. 24, 1997

[54] INDICATOR BANDS WHICH SHOW RATING AND PROPER ASSEMBLY OF HIGH VOLTAGE ACCESSORIES

[75] Inventor: Frank M. Stepniak, Andover, N.J.

[73] Assignee: Amerace Corporation, Hackettstown, N.J.

[21] Appl. No.: 488,570

[22] Filed: Jun. 8, 1995

[51] Int. Cl.[6] ..... H01R 3/00

[52] U.S. Cl. ..... 439/491

[58] Field of Search ..... 439/488, 489, 439/491

[56] References Cited

U.S. PATENT DOCUMENTS 4,227,762 10/1980 Scheiner ..... 339/91 R
4,781,619 11/1988 Ikeda ..... 439/488
4,784,614 11/1988 Behzadi ..... 439/488
4,902,244 2/1990 Endo et al. ..... 439/489
5,114,363 5/1992 Mitra ..... 439/491
5,529,513 6/1996 Lee ..... 439/491

*Primary Examiner*—P. Austin Bradley
*Assistant Examiner*—Yong Kim
*Attorney, Agent, or Firm*—David Teschner, Esq.

[57] ABSTRACT

To be able to determine from ground level the ratings and proper assembly of separable components of a high voltage system placed at groud level, below ground level, in a cable vault or above ground supported by utility towers a series of colored bands are placed about such components. Grooves are molded in the component housing and colored bands are placed in these grooves. A first set of colored bands would be covered when the components are properly assembled but the second set would remain exposed so that the ratings could be determined at all times.

14 Claims, 4 Drawing Sheets

INDICATOR BANDS WHICH SHOW RATING AND PROPER ASSEMBLY OF HIGH VOLTAGE ACCESSORIES

BACKGROUND OF THE INVENTION

1. Field of the Invention

The invention applies to separable high voltage accessories and more particularly to color bands about portions of the accessories which permit inspection from the ground of the accessory rating and correct assembly.

2. Description of the Prior Art

In some low voltage, low current devices, a color-coded pin is inserted in the corresponding color-coded connector housing. Another such device only allows the mating of two connector housings when the colored tabs on both housings match.

A further device uses multicolored bands at different positions along the length of the pins to be inserted into a housing. If the colored bands do not appear in a correct order, a pin may not be inserted far enough or it is in an incorrect slot in the housing. Another uses a bar code arrangement. Windows appear in the side wall of the housing. As the pins are inserted in the housing a colored band on the pin is visible through the windows. If the correct bar code does not appear once the pins are in place there is an assembly error.

These devices are for low voltage, low current connectors which can be assembled and inspected on the assembly bench.

For high voltage devices, such as three phase rated load-break elbow connectors and other high voltage accessories it is required that the device be marked by three colored bands which can be inspected from ground level to see that properly rated devices are being used. The first and third bands are white while the second, middle band is black. The typical method of doing this is to provide a band of plastic or rubber with these stripes or bands painted or otherwise placed thereon. The band is stretched to install it on the surface of the device and released so that the hoop forces and plastic memory cause the band to return towards its original size and grip the outside surface of the device. Because the band sits on the surface of the device it is subjected to various forces as the device is handled during installation and use. As a result the band maybe broken and fall off the device no longer permitting inspection from the ground and determining the proper rating of the device.

By placing the bands in a proper location on the device, bands can be used for yet another purpose. If the bands are placed on a device so that they are obscured by the correct installation of mating parts they can be used to indicate proper installation. If the bands or any part of them are visible then the devices are not properly mated. This condition can also be determined by inspection from the ground.

By using two sets of bands the rating and correct assembly of the devices can be shown. The first set of bands would be obscured to show proper assembly while the second set of bands will be visible to show the rating.

SUMMARY OF THE INVENTION

The instant invention overcomes the difficiencies of the prior art systems for marking high voltage devices as to their rating and provides a method of determining the correct installation of component devices which must be assembled.

The device to be marked for rating purposes is formed with two parallel grooves spaced from each other by a distance equal to the width of each of the grooves. The grooves are placed in such a position that they will be fully visible when the device is joined to another device. White bands of plastic or rubber are placed in the two grooves and the natural black of the device provides the intermediate black band.

This procedure can be used for proper assembly by placing the grooves in a position that they will be obscured if the devices are properly assembled or mated.

Two sets of bands can be used, a first to indicate assembly and the second to show rating. It is an object of the instant invention to provide apparatus and methods to mark a high voltage device which is resistant to damage during installation and use.

It is another object of the instant invention to provide apparatus and method to mark a high voltage device with its rating which is resistant to damage during installation and use.

It is still another object of the instant invention to provide apparatus and method for marking a high voltage device using a set of spaced parallel grooves in the outer surface of the device into which colored bands can be inserted.

It is another object of the present invention to provide spaced parallel grooves in the surface of a device so that bands of color can be inserted in said grooves and surface of the devices provides a further colored band.

It is yet another object of the present invention to use colored bands placed in grooves in the device surface to indicate proper assembly of the device with another device and its rating.

Other objects and features of the invention will be pointed out in the following description and claims and illustrated in the accompanying drawings, which disclose by way of example, the principles of the invention and the best modes presently contemplated for carrying them out.

BRIEF DESCRIPTION OF THE DRAWINGS

In the drawings in which similar element are given similar reference characters.

DESCRIPTION OF THE PREFERRED EMBODIMENTS

Figure 2:
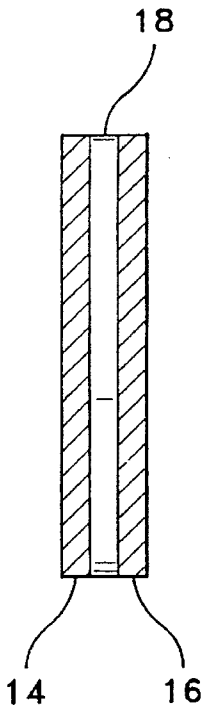
FIG-2 PRIOR ART
FIG. 2 is a side elevational view of a colored band according to the prior art which is installed in the device of FIG. 1.
Figure 1:
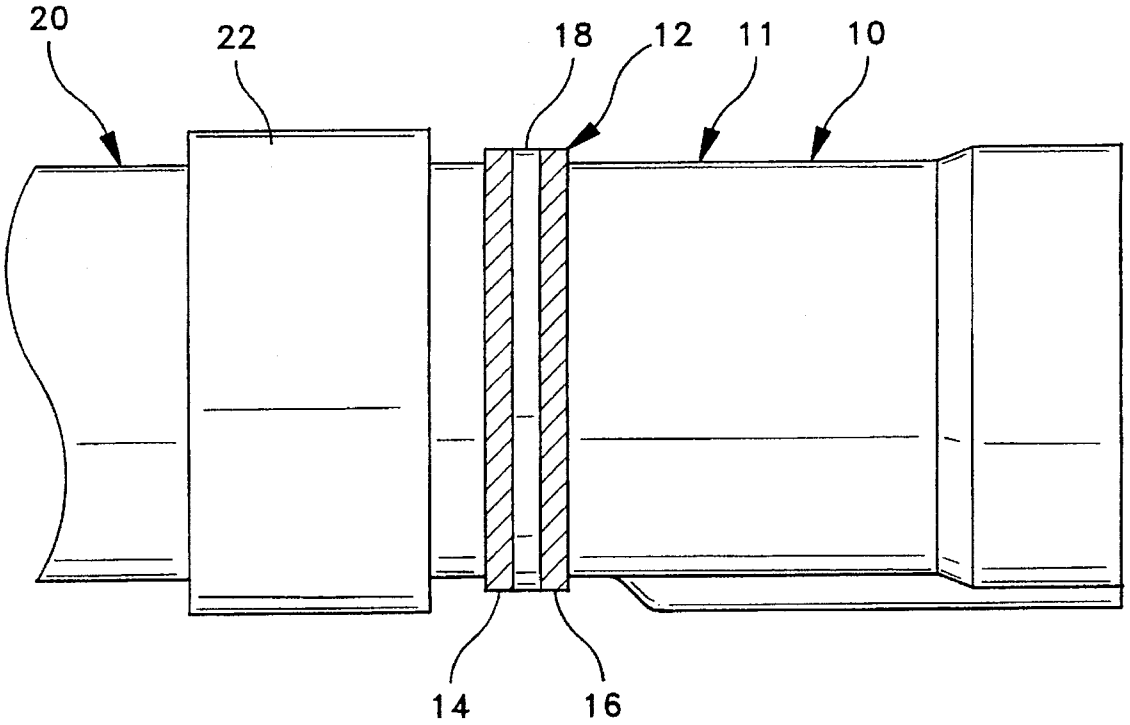
FIG-1 PRIOR ART
FIG. 1 is a side elevational view of a high voltage bushing insert marked according to the prior art with a fragmentary portion of a high voltage elbow attached.

Turning to FIGS. 1 and 2, a high voltage device marking system according to the prior art is shown. A bushing insert 10 has a colored band 12 made up of a black stripe 18 flanked by white stripes, 14 and 16. The band 12 as shown in FIG. 2 is a separate unitary device and may be made of plastic or rubber capable of being stretched and which will attempt to recover to its original size when released. The band 12 is stretched over the end of the bushing insert 10, (not visible) which is obscured by the cuff 22 of an installed high voltage elbow 20, and positioned as desired and released to try to recover its original size and thus tightly gripping the surface 11 of bushing insert 10. Because it remains on the bushing insert 10 surface 11, the band 12 is exposed to various forces during handling, installation, removal and use. These forces can cause the band 12 to break and fall off the bushing insert 10, no longer indicating the bushing insert 10 rating and no longer inspectable from the ground.

Figure 3:
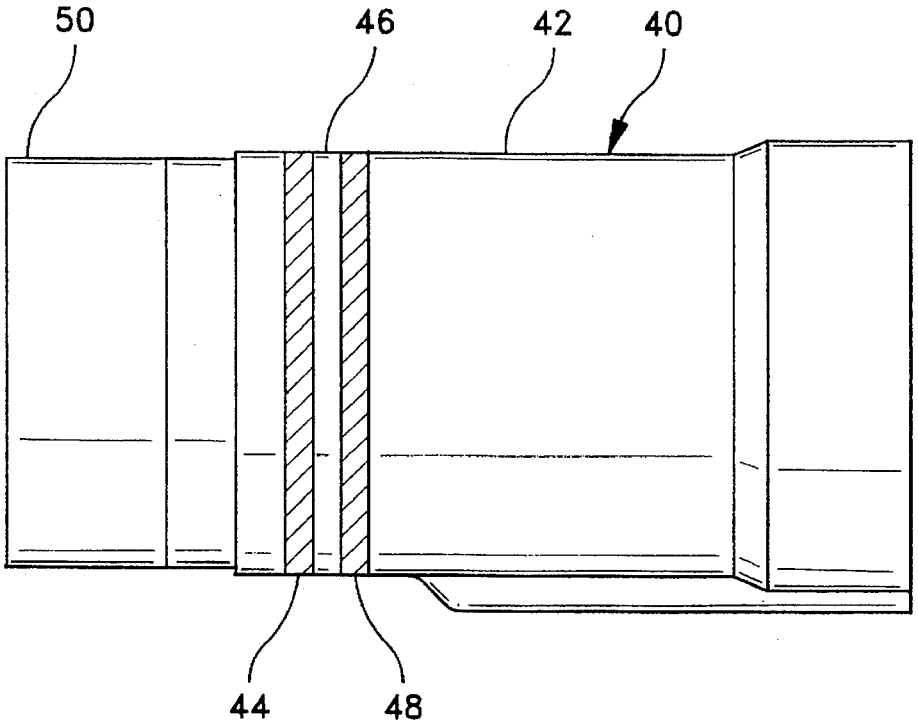
FIG. 3 is a side elevational view of a bushing insert marked according to the instant invention.
Figure 5:
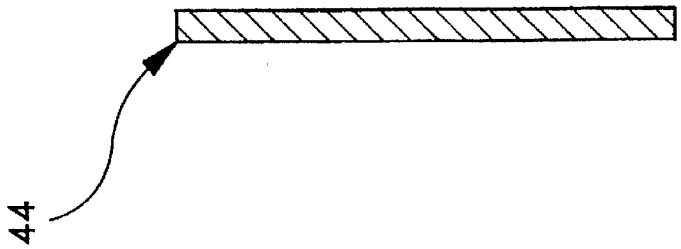
FIG. 5 is a side elevational view of the colored bands used to mark the device of FIG. 3.
Figure 4:
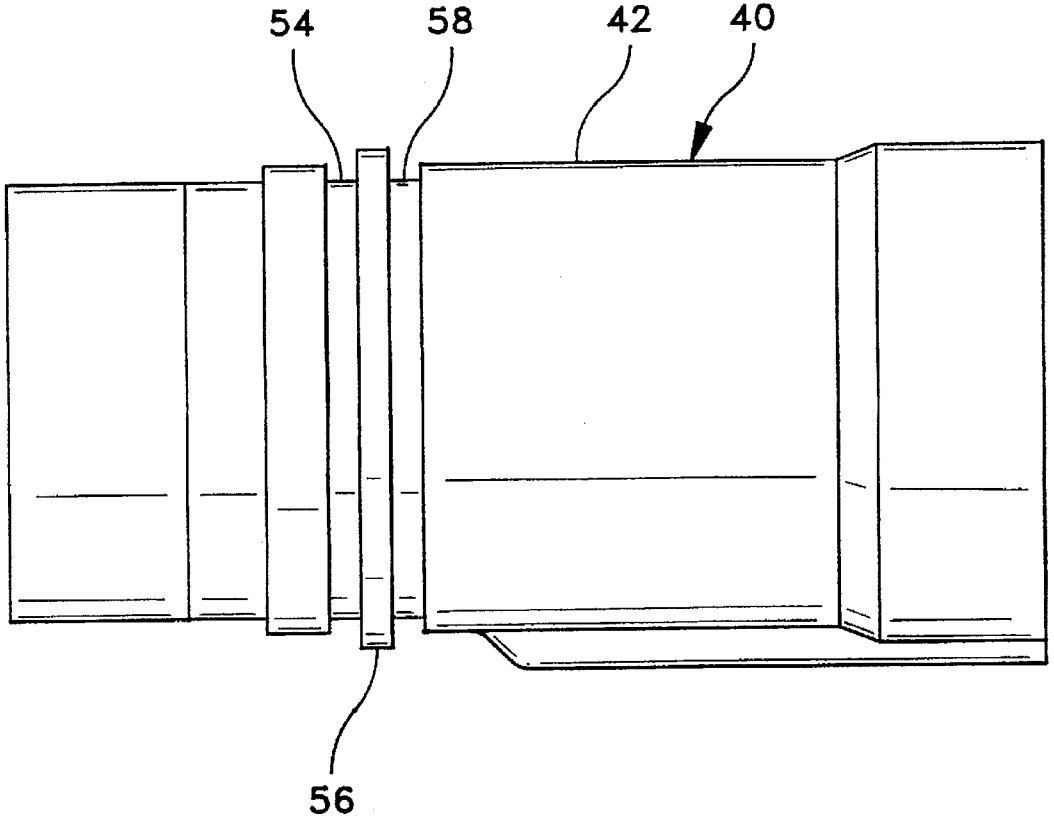
FIG. 4 is a side elevational view of the device of FIG. 3 without the colored bands installed.

Referring to FIGS. 3, 4 and 5 a marking system according to the invention is shown. A bushing insert 40 is shown having an outer surface 42 in its mid-portion. Colored bands 44 and 48 flank colored band 46. Colored bands 44 and 48 are white and band 46 is black as required by the accepted marking system standards. The difference between the markings of bushing insert 40 and that of bushing insert 10 is quite evident. The bands 44,46 and 48 are at the same level as bushing insert 40 outer surface 42 and do not project above it as band 12 does with bushing insert 10 surface 11. With this arrangement, the bands 44,46 and 48 are far less subject to the forces applied to bushing insert 40.

As shown in FIG. 4, the surface 42 of bushing insert 40 is formed with two parallel, spaced apart annular grooves 54 and 58. The grooves 54 and 58 are wide enough and deep enough to receive a colored band 44 or 48 as shown in FIG. 5. (Only band 44 is shown, but band 48 is the same). The white colored band 44 is stretched to position it over the surface 42 of bushing insert 40 and over its groove 54. The band 44 is then released and attempts to recover its original size as a result it securely grips the floor of the annular groove 54 and its outer periphery is even with the outer surface 42 of the bushing insert 40. The same thing is repeated for band 48 to be positioned in groove 58. The black band 46 is achieved by using the normal black color of the bushing insert 40. The resultant marking is far less subject to the destructive forces which can destroy band 12 of the prior art. When the cuff 22 of an elbow 20 is placed over the brushing insert 40 it does not obscure the bands 44,46 and 48 which are visible from the ground completely mated.

Alternatively, a set of bands, such as 44,46 and 48 can be positioned closer to the end of bushing insert 40. The bands 44 and 48 are similarly placed in grooves such as 54 and 58 of FIG. 4 with the surface providing intermediate band 46. The bands 44, 46 and 48 are intended to be covered completely by the cuff 22 of elbow connector 20 to show they are completely mated. If any part of band 48 or more is visible proper installation has not occurred.

Figure 6:
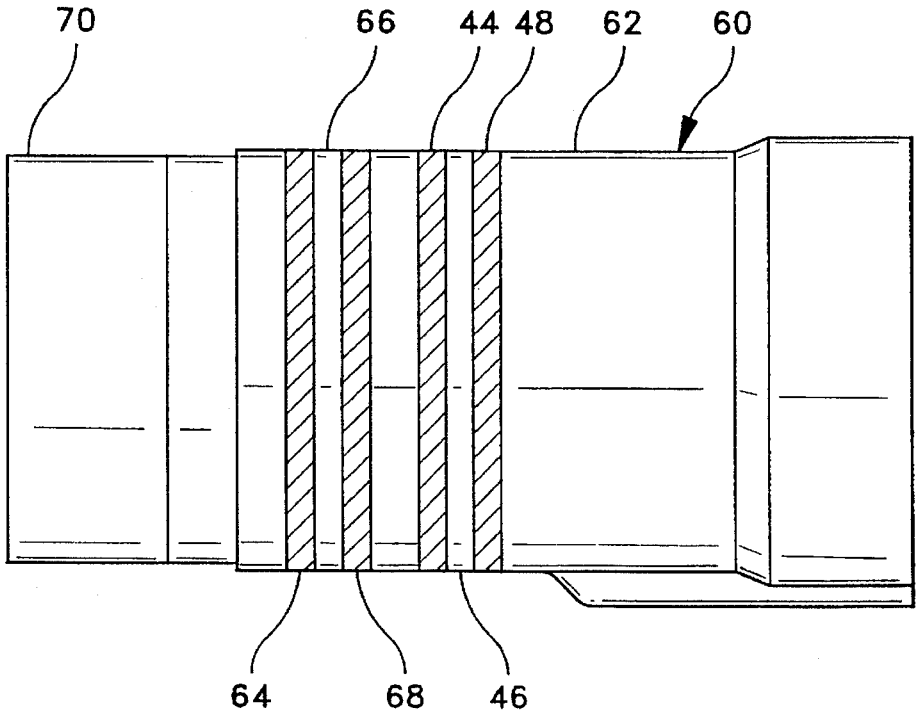
FIG. 6 is a side elevational view of a bushing containing two sets of marking color bands.
Figure 7:
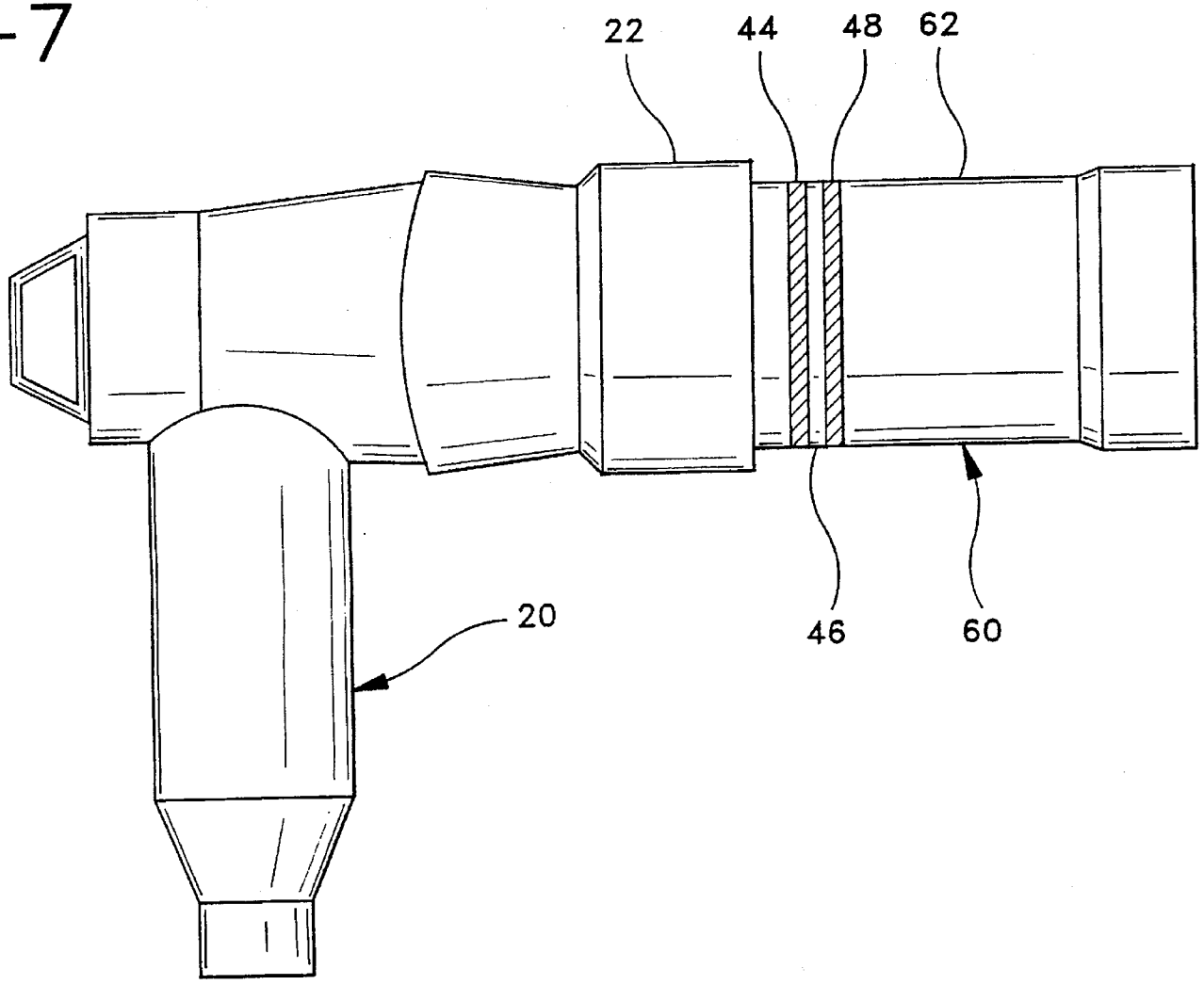
FIG. 7 shows the device of FIG. 6 installed an elbow.

If desired both sets of bands can be applied to the same bushing insert. As shown in FIG. 6, the bushing insert 60 has a first set of bands 44, 46, and 48 far enough from end 70 so as not to be covered by cuff 22 of elbow 20 when properly installed to bushing insert 60 as shown by FIG. 7. The bands 44 and 48 are fabricated and installed below the level of surface 62 as described with reference to FIGS. 3,4 and 5.

A second set of bands 64,66 and 68 closer to end 70 of bushing insert 60 (see FIG. 6) are also placed in grooves (not shown) as described above with reference to FIGS. 3, 4 and 5. When an elbow is properly positioned, as in FIG. 7 the bands 64,66 and 68 are covered by cuff 22. If any of these bands are visible than the elbow was not properly installed on bushing insert 60.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

The embodiments of the invention in which an exclusive property or privilege is claimed are defined as follows:

1. A method for marking a high voltage device with identification bands comprising the steps of:

a) forming a first annular groove in the surface of the device;

b) forming a second parallel annular groove in the surface of the device spaced from said first groove;

c) selecting and placing a first resilient band in said first groove, said first band having a width equal to the width of said first groove and a thickness equal to the depth of said first groove; and d) selecting and placing a second resilient band in said second groove, said second hand having a width equal to the width of said second groove and a thickness equal to the depth of said second groove.

2. The method as defined in claim 1, comprising the additional step of:

molding said device with said first and second grooves therein.

3. The method as defined in claim 1, comprising the additional step of:

cutting said first and second grooves in said device.

4. The method as defined in claim 1, comprising the additional steps of:

a) selecting a color for said first band different than the color of said device between said first and second grooves; and b) selecting a color for said second band different than the color of said device between said first and second grooves.

5. The method as defined in claim 4, wherein:

said chosen colors for said first band and said second band are the same.

6. The method as defined in claim 5, wherein both of said bands are white and said device is black.

7. The method as defined in claim 1, comprising the further steps of:

a) forming a third annular groove in the surface of said device;

b) forming a fourth parallel annular groove in the surface of said device spaced from said first grove;

c) positioning said third and fourth grooves closer to a free end of said device than said first and second grooves;

d) placing a third resilient band in said third groove; and e) placing a fourth resilient band in said fourth groove.

8. A separable component of a high voltage system comprising:

a) a cylindrical housing having a first end and a second end;

b) means in said first end to receive and connect to a further separable component of a high voltage system;

c) said cylindrical housing having a substantially smooth continuous surface between said first and said second ends;

d) a first annular groove in said housing in a plane perpendicular to the longitudinal axis of said housing spaced from said first end;

e) a second annular groove in said housing in a plane perpendicular to the longitudinal axis of said housing and spaced apart from and parallel with said first groove, said second groove being further from said first end than said first groove;

f) a first band placed in said first groove, said first band having a width equal to the width of said first groove and a thickness equal to the depth of said first groove; and g) a second band placed in said second groove, said second band having a width equal to the width of said second groove and a thickness equal to the depth of said second groove.

9. A separable component as defined in claim 8, wherein each of said first and second bands are of a color different than the color of the surface of said housing.

10. A separable component as defined in claim 8, wherein both of said first and second bands are of the same color and different than the color of the surface of said housing.

11. Separable component as defined in claim 10, where both bands are white and the surface of said housing is black.

12. A separable component as defined in claim 8, wherein said first and second bands are spaced by a distance from said first end whereby said bands remain visible when a further separable component is coupled to said separable component of a high voltage system to permit the determination of the rating of said separable component from ground level when said high voltage system is supported on utility towers.

13. A separable component as defined in claim 8, wherein said first and second bands are spaced by a distance from said first end whereby said bands are covered when a further separable component is correctly coupled to said separable component of a high voltage system to permit the determination of the correct assembly of said further separable component with said separable component from ground level when said high voltage system is supported on utility towers.

14. A separable component as defined in claim 12, further comprising:

a) a third annular groove in said housing in a plane perpendicular to the longitudinal axis of said housing spaced from said first end by a distance less than that of said first groove;

b) a fourth groove in said housing in a plane perpendicular to the longitudinal axis of said housing and spaced apart from a parallel with said third groove, said fourth groove being further from said first end than said third groove but closer than said first groove;

c) a third band placed in said third groove;

d) a fourth band placed in said fourth groove; and e) said third and fourth bands are spaced by a distance from said first end whereby said third and fourth bands are covered when a further separable component is correctly coupled to said separable component of a high voltage system to permit the determination of the correct assembly of said further separable component with said separable component from ground level when said high voltage system is supported on utility towers.

* * * * *